United States Patent [19]

Hall

[11] 4,315,656

[45] Feb. 16, 1982

[54] METHOD FOR REDUCING POROSITY OF RUBBLIZED OIL SHALE

[75] Inventor: Robert D. Hall, Wheaton, Ill.

[73] Assignee: Standard Oil Company (Indiana), Chicago, Ill.

[21] Appl. No.: 133,148

[22] Filed: Mar. 24, 1980

[51] Int. Cl.[3] ..... E21C 41/10; E21B 43/247

[52] U.S. Cl. ..... 299/1; 166/251; 166/261; 299/2

[58] Field of Search ..... 299/2, 1; 166/251, 261

[56] References Cited

U.S. PATENT DOCUMENTS

| | | | |
|---|---|---|---|
| 3,198,249 | 8/1965 | Willman | 166/251 |
| 3,547,195 | 12/1970 | Elkins | 166/261 |
| 3,978,920 | 9/1976 | Bandyopadhyay et al. | 166/261 |
| 4,166,721 | 9/1979 | Cha | 299/1 X |
| 4,231,617 | 11/1980 | Larson et al. | 299/2 |

*Primary Examiner*—Ernest R. Purser

*Attorney, Agent, or Firm*—Thomas W. Tolpin; William T. McClain; William H. Magidson

[57] ABSTRACT

Disclosed is a method for reducing the porosity of a zone within mass of unretorted rubblized oil shale comprising locating the zone; providing fluid communication to the zone; introducing grout slurry by fluid communication to the zone so as to deposit slurry and reduce porosity. Also disclosed is an improved method for the subterranean in situ retorting of oil shale comprising establishing a retorting zone containing a rubblized mass comprising oil shale; establishing an essentially planar flame front within the retorting zone; introducing oxygen containing gas into the retorting zone to support combustion at the flame front thereby forming hot combustion gases which effect retorting of the oil shale; locating an area of the flame front which advanced ahead of the essentially planar flame front; and introducing grout slurry to the advanced area to reduce gas permeability and retard further advancement of that area of the flame front.

7 Claims, 1 Drawing Figure

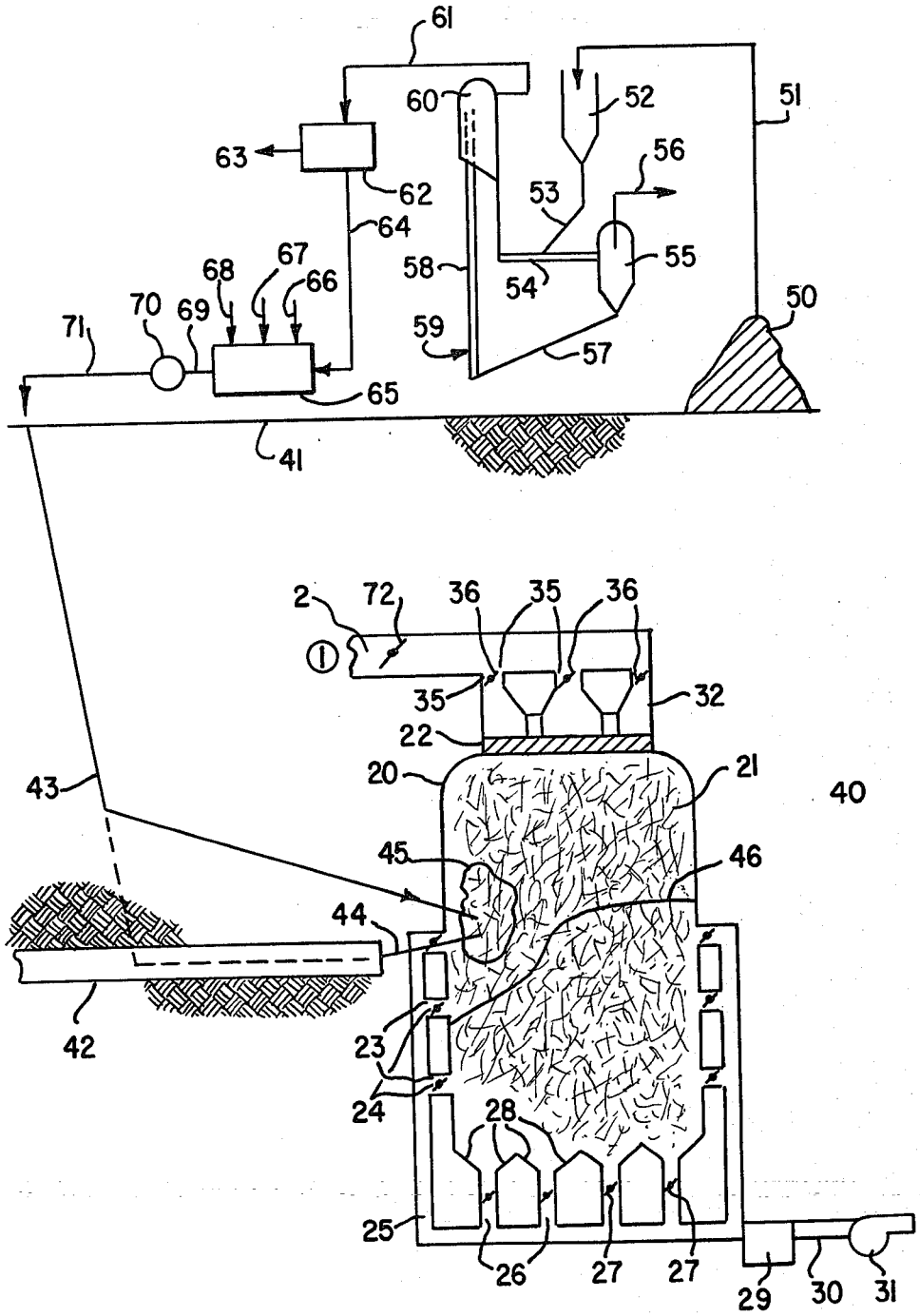
61
60
52
51
63
56
62
53
64
55
58
54
68
67
66
70
69
50
71
59
57
65
41
2
72
36
35
36
35
32
22
20
21
40
43
45
46
44
42
23
24
28
25
26
27
27
29
30
31

METHOD FOR REDUCING POROSITY OF RUBBLIZED OIL SHALE

BACKGROUND

This invention relates to a method for reducing the porosity of rubblized oil shale and the recovery of carbonaceous materials from underground deposits. More specifically, this invention relates to the subsurface combustion and retorting of oil shale.

Numeroud hydrocarbonaceous materials are found in underground deposits; for example crude oil, coal, shale oil, tar sands, and others. One method of recovering energy or hydrocarbon from such underground deposits is by underground combustion. An oxidizing gas such as air can be provided to an underground combustion zone so as to combust a portion of the combustible material contained therein and use the energy of combustion to free hydrocarbon or thereby form materials which are suitable for energy recovery. For example, air or oxygen, and diluent gases such as steam, can be passed into a coal deposit so as to form off-gases having combustible materials such as light hydrocarbons and carbon monoxide. These gases can then be combusted directly for heat, or energy recovered such as through power generation. Underground combustion can be used in the recovery of petroleum crude oil from certain types of deposits. Air or oxygen, and steam, is passed into an underground deposit and combustion initiated so hot combustion gases will aid in the recovery of such crude oil. Similar technique can be used in the recovery of oil from tar sands. One important use of underground combustion is in the recovery of oil from oil shale.

The term "oil shale" refers to sedimentary deposits containing organic materials which can be converted to shale oil. Oil shale is found in various places throughout the world, especially in the United States in Colorado, Utah, and Wyoming. Some especially important deposits can be found in the Green River formation in the Piceance Basin, Garfield and Rio Blanco counties, in Northwestern Colorado.

Oil shale contains organic material called kerogen which is a solid carbonaceous material bound chemically to the inorganic matter from which shale oil can be produced. Commonly oil shale deposits have variable richness or kerogen content, the oil shale generally being stratified in horizontal layers. Upon heating oil shale to a sufficient temperature, kerogen is decomposed and liquids and gases are fomed. Oil shale can be retorted to form a hydrocarbon liquid either by in situ or surface retorting. In surface retorting, oil shale is mined from the ground, brought to the surface, and placed in vessels where it is contacted with hot retorting materials, such as hot shale or gases, for heat transfer. The resulting high temperature causes shale oil to be freed from the rock. Spent retorted oil shale which has been depleted in kerogen is removed from the reactor and discarded. Some well known methods of surface retorting are the Tosco, Lurgi, Paraho and fluid bed retorting processes.

Another method of retorting oil shale is the in situ process. In situ retorting can be pure in situ retorting or modified in situ retorting wherein work is conducted underground to make the underground resource more suitable for retorting. In situ retorting can be conducted in vertical, horizontal, slanting, or other retorts. In one case, in situ retorting of oil shale comprises forming a retort or retorting zone underground, preferably within the oil shale zone. The retorting zone can be formed by mining an access tunnel to or near the retorting zone and then removing a portion of the oil shale deposit by conventional mining techniques. About 2 to about 45 percent, preferably about 15 to about 40 percent, of the oil shale in the retorting area is removed to provide void space in the retorting area. The oil shale in the retorting area is then rubblized by well-known mining and blasting techniques to provide a retort containing rubblized shale for retorting. In some cases it is possible to rubblize underground oil shale without removal of a portion of the oil shale. However, it is generally preferable to remove material so as to provide void space which will result in more uniform rubblization and more efficient use of explosives.

A common method for forming the underground retort is to undercut the deposit to be retorted and remove a portion of the deposit to provide void space. Explosives are then placed in the overlying or surrounding oil shale. These explosives are used to rubblize the shale, preferably forming a zone of rubble having uniform particle size and void spaces. Sone of the techniques used for forming the undercut area and the rubblized area are room and pillar mining, sublevel caving, crater retreat and the like. Because of the stratification of oil shale it may be desirable to selectively mine material based on its mineral or kerogen content for removal from the retorting zone. Also because of the stratification, the retorting zone may contain lean oil shale, or rock containing essentially no kerogen. After the underground retort is formed, the pile of rubblized shale is subjected to retorting. Hot retorting gases are passed through the rubblized shale to effectively form and recover liquid hydrocarbon from the oil shale. This can be done by passing a gas comprising air or air mixed with steam through the deposit. Air can be forced into one end of the retort and a fire or flame front initiated. Combustion can be initiated by introducing fuels such as natural gas, propane, shale oil, and the like which are readily combustible with air. After combustion has been initiated, it can be sustained by combusting coke on spent or partially spent oil shale, oxygen contacting the coke forming or maintaining a flame front. This flame front is then passed slowly through the rubblized deposit to effect the retorting. Actually the hot combustion gases passing ahead of the flame front caused the retorting of oil shale and the formation of shale oil. Another suitable retorting fluid comprises hot retorting off-gas from the same or nearby underground retort. Not only is shale oil effectively produced, but also a mixture of off-gases is produced during retorting.

A number of patents describe methods of in situ retorting of oil shale, such as Karrick, L.C., U.S. Pat. Nos. 1,913,395; Karrick, 1,919,636; Uren, 2,481,051; Van Poollen, 3,001,766; Ellington, 3,586,377; Prats, 3,434,757; Garrett, 3,661,423; Ridley, 3,951,456; and Lewis, 4,017,119 which are hereby incorporated by reference and made a part hereof.

One problem in the underground combustion and retorting of carbonaceous materials such as shale oil deposits is the difficulty in forming and maintaining a uniformly oriented or even flame front. This can be due to variation in the size and disposition of the air space between the rubblized matter within the retort, variation in the size of the rubblized matter, variation in oil shale richness, and the like. If a portion of the flame front advances more quickly than other portions, large portions of the rubblized matter will be bypassed and will not be effectively retorted and the overall recovery of energy from the deposit will be diminished. This is partially attributable to the difficulty in forming a perfectly uniform rubblized mass with uniform gas passages, and also uniformly passing gas into and out of the retorting area. Generally this problem is attributable to variable porosity of the rubblized matter, this is, the variability in resistance to gas flow through the rubblized matter. If a narrow portion of the flame front or hot zone advances completely through the retorting area, oxidizing gas which is passed into one end of the retort can eventually break through the flame front at the leading position and pass to the off-gas collection system (breakthrough). This will naturally overload the off-gas collection system with oxidizing gas which has not had an opportunity to partake in the combustion process. Therefore, flame front breakthrough can lead to the termination of retorting of an oil shale retort before all of, or even a substantial portion of, the rubblized mass of oil shale is retorted, thereby lowering energy recovery from a retort. Flame front breakthrough can also be dangerous because it can result in a combustible or explosive gas composition in the product recovery zone.

Knepper et al, U.S. Pat. No. 4,120,355 teach the use of grout slurries to stabilize spent oil shale retorts including providing communication to the retort and suitable grouts of water and spent oil shale from surface retorting. Knepper et al do not teach the use of grouts in unretorted masses of oil shale nor the selective use of grouts, within zones in a retort.

It is an object of this invention to provide a process for the efficient recovery of energy from underground deposits of hydrocarbon so that higher yields of energy can be recovered from a given deposit.

It is an object of this invention to prevent the overloading of off-gas recovery systems attendant to underground combustion processes and preventing dangerous gas compositions in off-gass recovery systems.

It is an object of this invention to retort substantially all of the rubblized oil shale within a retort, thereby maximizing energy recovery.

it is an object of this invention to reduce the porosity of zones of rubblized oil shale to modify the rate of gas flow through such zones, and thereby control retorting.

SUMMARY OF THE INVENTION

The objects of this invention can be attained by a method for reducing the porosity of a zone within mass of rubblized oil shale comprising locating the zone; providing fluid communication to the zone; introducing grout slurry by fluid communication to the zone so as to deposit slurry and reduce porosity. This is done to control gas flow through the retort. The zone can be a zone of high porosity or near a zone of high porosity, and can be within a mass of unretorted rubblized oil shale. In this case, the grout slurry would be introduced to the zone in order to reduce the porosity of the zone, that is, to reduce the ease of passing gases through the zone.

Oil shale retorting can be effected by an improved method for the subterranean in situ retorting of oil shale comprising establishing a retorting zone containing rubblized mass comprising oil shale, and establishing an essentially planar flame front within the retorting zone. It is desirable to maintain the flame front substantially perpendicular to the flow of gases in the retort, and substantially perpendicular to the direction of flame front advancement. Oxygen containing gas is introduced into the retorting zone to support combustion at the flame front thereby forming hot combustion gases which effect retorting of the oil shale. If an area of the flame front advances ahead of the essentially planar flame front, it is located and grout slurry is introduced to or near the advanced area to reduce gas permeability and retard further advancement of that area of the flame front.

The underground retorts can be horizontal or vertical, and of various shapes such as rectangular, cylindrical, elongated, or irregular and are formed by well-known means. The zone to receive the slurry can be located before retorting is initiated by appropriate detectors, such as by gas tracer. A porous zone can be located after retorting of a subterranean in situ has begun by locating nonplanarity or uneven advancement of the flame front. Commonly the flame front will advance more rapidly at areas of, or at areas downstream of, porous zones.

Retorting can be conducted by passing hot retorting fluid through the mass of rubblized shale to heat such shale to a temperature sufficient to produce shale oil and gases. The hot retorting fluid preferably comprises combustion gases. One method of conducting such retorting is to establish a flame front in the mass of oil shale by use of a burner, combustible liquids or gases, hot gases, or the like, and passing an oxygen containing gas to such flame front to support combustion, primarily of coke on spent retorted shale.

The oxygen containing gas comprises air, oxygen, combustion gases, or mixtures thereof. Preferably the gas also comprises steam so as to increase its heat capacity and help control flame front and retorting temperature.

Retorting fluid can be passed into such retort in any direction such as upward, downward, sideways or transversely. Retort configuration and operation is sometimes dictated by the nature of the oil shale formation. It is sometimes preferred to use a vertical retort with hot retorting gases passed predominantly in a downward direction so that shale oil formed, often in mist form, and also coalesced oil on rubble, can pass essentially downwardly aided by gravity and gas flow.

Position or disposition of flame fronts are preferably detected by use of thermocouples, however other techniques and apparatus described in McCollum, U.S. Ser. No. 925,178, now U.S. Pat. No. 4,199,026; Ginsburgh, et al., U.S. Ser. No. 925,176, now U.S. Pat. No. 4,210,876; and Ginsburgh, et al., U.S. Ser. No. 925,177, now U.S. Pat. No. 4,210,868, all filed July 17, 1978, U.S. Pat. No. 4,120,354 (Ridley et al.); 4,148,529 (Burton III); and 4,149,592 Burton et al. and all which are hereby incorporated by reference and made a part hereof.

When a porous zone is located, fluid communication is provided to such zone so that slurry can be delivered to or near the porous zone. Communication can be provided from the ground surface, or from various tunnels, raises and sublevels underground.

One method of providing communication from the surface or from a drill hole to an underground retort, especially lateral communication, is by directional drilling. One method of directional drilling comprises drilling roughly vertically until at some point the well or shaft is diverted off at an angle from the original shaft. The shafts may be cased or uncased depending on the type of formation being drilled, but in many cases they are cased. The shaft generally extends from the surface or from a drill hole laterally into the retort. Until fairly recently a whipstock was used to deviate wells. This consisted of a tapered steel wedge which was run to the bottom of the hole and orientated so that it pushed the bit off in the desired direction. There were some drawbacks with this tool. The bit used to kick off the hole was always smaller than the required hole and drilled a pilot hole which had to be enlarged. The whipstock also had to be pulled out of the hole and reset every few feet, after the pilot hole was opened out, in order to achieve sufficient angle build up.

The more modern method of kicking off a directional well commonly uses a down-hole motor or a turbodrill and a "bent sub". The string consists of a full gauge bit, turbodrill, bent sub, non-magnetic drill collar, drill collars and drill pipe. The bent sub, or angle sub, is a short piece of drill collar on which the axis of the pin is at an angle relative to the axis of the box. The angle is generally small, ranging from $\frac{1}{2}°$ to 3°. The non-magnetic drill collar is used to provide a seat for the magnetic survey instruments which are run to survey the hole. Before kick-off the turbodrill assembly is run to the bottom of the hole and a survey is taken, the instruments being run into the drill string on a wire line or the sandline. The survey instruments consist of a plumb-bob and a compass which show the inclination and direction of the drill string and the non-magnetic collar. They both can be contained within a pressure-tight case, and when seated in the collar a time-actuated camera can photograph their readings. Upon retrieval from the hole the film is rapidly developed and their readings are obtained. The kick-off string is then orientated and the mud-circulation started. The turbine drives the bit with the remainder of the string restrained from rotating to maintain the direction, while building angle. The rate of building up depends on the formation and the angle of the angle sub employed.

Drilling with the motor or turbodrill continues until an adequate angle build-up is obtained, a survey being taken at intervals. The turbodrill is then pulled out of the hole and a rotary drilling string is run to continue drilling. By using various combinations of weight and rotary speed, and by changing the position of stabilizers in the drill collar string, to increase or decrease their pendulum effect, the hole can be made to build, maintain or lose angle or to change direction. This is part of the art of directional drilling, and one or two wells in any area have to be drilled before the effects of various drilling assemblies can be forecast. The degree of control required on a directional hole varies from place to place, depending on the nature of the formation being drilled, its dip, etc. and it is a case of trial and error to discover the best assemblies to use.

The hole is surveyed frequently during angle build up, but once the course is established the interval is increased. A plot of the track of the hole is kept, showing the horizontal and vertical section, to ensure that it is staying on course.

Another method of providing communication with an underground retort comprises locating one or more drill holes sufficiently near the retort and blasting that portion of the formation which restricts communication between the drill hole and the retort. This can be done, for example, by drilling a shaft from a few inches to a few feet in diameter, in the undisturbed formation almost immediately adjacent to an underground retort. It is generally desirable to size this hole or shaft considering its end use, speed of drilling desirable, and economy. Generally a hole about 2 to about 12 inches in diameter is preferable. The drill hole is located near the retort so that explosives placed within the drill hole will be able to blast that portion of the formation which restricts communication between the drill hole and the retort. In many cases, it is desirable to locate the drill hole so that it runs alongside the underground retort for a considerable distance. Then explosives can be set at various locations to provide communication at multiple locations with the underground retort.

Generally, the drill holes are spaced about 2 to about 10 feet from the subterranean in situ retort. It is sometimes difficult to space the drill hole precisely when there is a substantial amount of overburden. When the drill hole is near the retort, the drill hole can be generally exploded directly into the retort. Where there is a larger space between drill hole and retort, it may be necessary to first blast to form a small cavity at the proper depth, and then fill the cavity with explosives to establish communication with the retort. It is preferable to stem the blasts in order to get maximum utilization of the explosives.

Several commercially available industrial or mining explosives can be used. The most logical choices are dynamite, nitroglycerine, TNT, ammonium nitrate, and liquid oxygen explosives. The preferred explosives are ammonium nitrate slurries for they are the most efficient commercial blasting agent now in use. However, ammonium nitrate like TNT is comparatively difficult to detonate and therefore it is necessary to use a blasting cap or a similar activating device to set it off. In a way, this is beneficial for it increases the safety factor and insures that an explosive will not go off prematurely. Mining Engineers' Handbook, Third Edition, Volume 1, Section 4, published by John Wiley & Sons, Inc., New York, explains in detail the chemistry of explosives, peak blast pressure, influence of loading density, history of shaped-charged phenomena, explosive factors in cavity effect, as well as charging and firing characteristics. Section 4 of this text is incorporated by reference and made a part hereof.

Surface retorting of mined oil shale can be conducted by a number of methods. Currently, a number of processes such as TOSCO and Lurgi are nearing commercial reality. In the Lurgi type retorting raw fresh shale is fed into a mixer wherein it is contacted with hot spent or partially spent shale. The combined oil shales are then fed into a zone wherein the shale oil which has been retorted from the oil shale is separated from the shale. The oil is recovered and the spent and partially spent shale is passed to a zone wherein carbon is burned off the shale. This can be done by introducing air or air and fuel to the zone to combust the carbon. A preferred method is to pass the spent and partially spent shale, and air or air and fuel upwardly through a vertical elongated zone such as a lift pipe. A portion of the spent shale is then removed from the flue gas from said zone, for example, by electrostatic precipitators, and used for slurry backfilling. Another portion of the spent shale is fed to the mixer to transfer that to fresh oil shale.

The spent oil shale preferably has certain properties. The spent shale should contain less than about 0.2 weight percent carbon, still more preferably less than about 0.1 weight percent carbon, so that the spent shale can be suitably wet by water. The particle size of spent shale is of some importance and preferably the spent shale should be smaller than about 150 mesh, more preferably smaller than about 200 mesh. Variations in the particle size of the spent shale may affect the viscosity and pumpability of the slurry of water and spent oil shale from surface retorting.

Slurries of water and spent shale from surface retorting can be made over wide ranges of water concentration. Generally, slurry viscosity is lowered and handling, pumping and spreading properties improved at higher water concentrations. Water content of these slurries is expressed as weight of water/weight of dry solid, and can be greater than 100 percent. The slurries have a water content of about 50 to about 300 weight percent, preferably about 50 to about 150 weight percent.

Other materials can be added to the slurry of water and spent shale from surface retorting in order to modify various properties of the slurry or the solidified mass formed by the slurry. For example, additives can be used to modify the slurry viscosity of the slurry or adjust the permeability to water or gas of the underground retort. Retarders can be added to stop flash set or prevent premature solidification of the slurry.

THE DRAWING

The attached drawing is a schematic diagram of an in situ retort exemplifying one embodiment of this invention.

Underground in situ retort 20 is an elongated rectangular vertical retort positioned within oil shale bed 40. Underground modified in situ retorts are generally first constructed by limited removal of a portion of the oil shale deposit followed by rubblization. The underground cavity which generally defines the retort is substantially filled with a rubblized mass of oil shale. Communication is provided to the retort for the introduction of fluids which comprise retorting fluids or will form retorting fluids within the retort. Communication is also provided from the retort for the removal of liquid and gaseous products therefrom. This particular retort is designed to have gasses passed into the top of the retort and other gases and liquids removed from near the bottom of the retort.

Identification and location of porous zone 45 prior to retorting can be effected by gas tracer tests such as those described in Occidental Vertical Modified In Situ Process For The Recovery of Oil From Oil Shale by Robert A. Loucks (November 1977) prepared for the U.S. Department of Energy under Contract No. EF-77-A-04-3873. Axial gas distribution in the rubble matter in the retort can be measured by injecting radioactive Krypton-85 into various inlets at the top of the retort, and then determining the length of time needed for the tracer to reach various detection points near the bottom of the retort. Radial gas distribution in the rubble can be measured by injecting carbon monoxide tracer into various inlet ports and detecting response times in adjacent holes. Naturally the tracer gases will flow more rapidly through zones of high porosity.

Identification and location of porous zone 45 can be effected during retorting by detection of flame front position 46 by thermocouples.

Because gases pass more rapidly through porous zone 45, the flame front 46 advances more rapidly on the left side of the retort. The position and disposition of the flame front can be determined by thermocouples placed at various locations in the retort.

When the desired zone for receiving slurry has been located, either before or after retorting has been initiated, fluid communication is provided to such porous zone. This can be accomplished by directional drilling from the surface or from a drift to provide drill hole 43 to the location of the porous zone. Fluid communication can also be provided through tunnel 42 which was originally used in the mining plan for the construction of this retort, and drill hole 44. Generally such tunnel is provided with a gas impermeable barrier such as a valve, wall, bulkhead or the like to prevent the leakage of combustion gases or air from the retort. In order to provide fluid communication, the valve is opened or the barrier removed by drilling or blasting.

While retort configuration is determined by the nature of the underground formation, some oil shale in situ retorts are elongated vertical cavities wherein air is introduced near the top of such cavity for in situ combustion and gaseous and liquid products are removed near the bottom. After such a retort is formed containing a mass of rubblized oil shale, heating fluid can be passed into the retort near the top so as to heat a sufficient portion of the oil shale or rock present. Commonly at least about 2 weight percent of the volume of rubblized mass of oil shale is heated to a temperature in excess of the shale oil pour point. Preferably at least 5 weight percent of the volume of rubblized mass of oil shale is so heated. The amount of the rubblized mass that requires heating is dependent on retort configuration, oil shale richness, retorting rate, and particle size.

The heating fluid commonly comprises hot air, combustion off-gases, carbon dioxide, and steam, or mixtures thereof. Preferably steam is used because of its low cost, high efficiency, and availability on site. Steam which is introduced into the rubblized mass of oil shale will contact and condense on the cool oil shale or rock, thereby warming it. As the oil shale or rock warms, the steam will pass beyond such warm rock to the adjacent zone of cool rubblized mass wherein the steam will condense thereon. In this manner the rock or oil shale is efficiently heated to the appropriate temperature without undue heating and possible formation of shale oil. Condensed steam or water can later be collected with other water in the product recovery system.

Subsequent to such heating, the rubblized mass near the top is ignited and combustion supported by the introduction of air, air/steam, air/diluent gases, and the like. Such combustion forms hot gases which effectively retort oil shale forming shale oil. Alternatively, hot retorting fluids can be provided by the hot off-gases from a nearby in situ oil shale retort.

A stoichiometric ratio of air to fuel can be used to combust start up fuel to initial combustion and form a flame front. Water or steam quench can be used to control the temperature of the resultant inert gas in the range of 500° to 1600° F., preferably about 1000° F.

Gases 1 to initiate or support in situ combustion are passed through line 2 to a manifolding area 32. Valves 72 and 36 control the flow of gas through passages 35 in the manifolding area. The gases can then be passed through perforations, holes, or passages in sill pillar 22 into and through rubblized mass 21 comprising oil shale.

Gases can be removed from the retort via passageways 23 which have been mined in the formation immediately adjacent to the retorting zone 20 and which are in communication therewith. Valves 24 are used to control the flow of gases from the retort into the passageways 23 for collection in the manifolding system 25. Liquid products from the retorting zone generally accumulate at the bottom of the retort because of gravity and because of gas flow in a downward direction, and pass along the sloping floors 28 of the retort through mined tunnels 26 and pass along a sloping floor in such tunnels to sump 29 where such liquids are collected. Commonly these liquids comprise hydrocarbon and water which are then separated for recovery or disposal. Gases can also be collected through tunnels 26 and gas flow can be controlled by valves 27 in such tunnels to control the removal of gases from the retort.

The oil shale which has been removed from the underground formation to provide for porosity for in situ retorts is commonly brought to the surface. This mass of oil shale 50 can then be ground or broken up to the appropriate size and retorted in surface retorts. The oil shale can be passed through line 51 to vessel or hopper 52 which then passes the oil shale through line 53 to mixer 54. In mixer 54, fresh shale is contacted with hot spent or partially spent shale and heat is transferred to the fresh shale. The mixture of shales is then passed into vessel 55 wherein shale oil is recovered from the shale and passed out of line 56 to recovery. Spent or partially spent oil shale is then passed through the bottom of vessel 55 through line 57 for further treatment, especially the removal of carbon. Pipe 58 is an elongated lift pipe which transfers spent or partially spent shale upward while air and/or fuel is passed upwardly through the same pipe from point 59. In this lift pipe carbon on shale is oxidized and the temperature of the spent shale is raised significantly. It is preferred to operate this lift pipe at a temperature of about 1200° F. to about 1500° F. in order to produce a suitable spent shale for slurry backfilling. The lift pipe is preferably operated at about 1300° F. Spent shale passes into vesel 60 and a portion of the hot spent shale then passes down to mixer 54 wherein it is contacted with fresh shale and transfers heat thereto. Off-gases containing some spent oil shale pass from vessel 60 through line 61 to electrostatic precipitator 62 which separates finally divided spent oil shale from off-gases. The off-gases are passed out through line 63. The spent shale is then passed from electrostatic precipitator 62 through line 64 to slurry tank 65. There it is contacted with water 66 and additives 67 and 68 which modify various properties of the slurry. The slurry is then passed through line 69 and can optionally be passed through pump 70, such as a slurry pump, through line 71 for injection into in situ retorts. In many cases, the slurry from slurry tank 65 can be passed by gravity down-hole without need for a slurry pump. When the slurry is passed into a zone in an in situ retort, it can be moved to various locations by gravity or hydrolyic pressure. When the slurry is allowed to set, a small amount of water may be given off, and the slurry will form a solid coherent mass which will reduce the gas permeability of the zone.

I claim:

1. An improved method for enhancing the recovery of shale oil from underground in situ retorting of a rubblized mass of oil shale, comprising the steps of:

locating a porous zone in an underground retort containing a rubblized mass of oil shale before said mass has been completely retorted;

introducing a grout slurry of water and spent oil shale containing less than 0.2% by weight carbon to said porous zone before retorting is completed to substantially minimize the porosity of said zone.

2. The process of claim 1 wherein said porous zone is located by gas tracers and said grout slurry of water and spent oil shale is introduced into said porous zone before retorting is initiated.

3. The process of claim 1 wherein said porous zone is located during retorting in general proximity to a rapidly advancing portion of a flame front in said retort and said grout slurry of water and spent oil shale is introduced during retorting into said porous zone.

4. The process of claim 1 wherein said spent oil shale is smaller than 150 mesh and the ratio of water to said spent shale by weight in said grout slurry is from 50% to 300%.

5. The method of claim 4 wherein:

said spent oil shale contains less than 0.1% by weight carbon;

said spent oil shale is less than 200 mesh; and said ratio is from 50% to 150%.

6. An improved method for the subterranean in situ retorting of oil shale, comprising the steps of:

establishing a generally planar flame front across an undergrond retort containing a rubblized mass of oil shale with a gas permeable porous zone;

advancing said flame front downwardly through said retort by introducing oxygen containing gas downwardly into the flame front to emit hot combustion gases and effect retorting of the oil shale immediately below said flame front;

said flame front becoming irregular with an advancing portion of said flame front moving substantially ahead of a lagging portion of said flame front adjacent said gas permeable porous zone;

detecting said gas permeable porous zone by locating said advancing portion of the flame front; and introducing a grout slurry of water and spent oil shale to said gas permeable porous zone during retorting wihout interrupting said retorting to minimize the gas permeability of said porous zone and the irregularity of said flame front so as to enhance the recovery of shale oil.

7. The method of claim 6 wherein said spent oil shale in said grout slurry is derived from surface retorting of oil shale.

* * * * *

UNITED STATES PATENT OFFICE

CERTIFICATE OF CORRECTION

Patent No. 4,315,656 Dated February 16, 1982

Inventor(s) Robert D. Hall

It is certified that error appears in the above-identified patent and that said Letters Patent are hereby corrected as shown below:

| Patent Column | Line | |
|---|---|---|
| 1 | 11 | "Numeroud" should be --Numerous -- |
| 2 | 55 | "Karrick" should be --Karrick S.N.-- |
| 2 | 56 | "3,001,766" should be --3,001,776-- |
| 3 | 44 | "it is an" should be --It is an-- |

Signed and Sealed this

Seventeenth Day of August 1982

[SEAL]

Attest:

GERALD J. MOSSINGHOFF

Attesting Officer

Commissioner of Patents and Trademarks